United States Patent [19]

Marchetti et al.

[11] 4,074,427

[45] Feb. 21, 1978

[54] AUXILIARY TRIMMER ASSEMBLY

[75] Inventors: Michael John Marchetti, Bridgeport; Edward Szymansky, Jr., Fairfield, both of Conn.

[73] Assignee: Sperry Rand Corporation, Bridgeport, Conn.

[21] Appl. No.: 648,056

[22] Filed: Jan. 12, 1976

[51] Int. Cl.[2] ..... B26B 19/10

[52] U.S. Cl. ..... 30/34.1; 30/201; 30/233

[58] Field of Search ..... 30/34.1, 90, 200–202, 30/233, 233.5

[56] References Cited

U.S. PATENT DOCUMENTS

| | | | |
|---|---|---|---|
| 1,245,833 | 11/1917 | Vass | 30/201 X |
| 2,941,293 | 6/1960 | Marzzoni | 30/201 |
| 3,237,304 | 3/1966 | Merzon | 30/201 |
| 3,360,857 | 1/1968 | Fortenberry | 30/34.1 |

FOREIGN PATENT DOCUMENTS

| | | | |
|---|---|---|---|
| 1,553,713 | 10/1970 | Germany | 30/34.1 |

*Primary Examiner*—Gary L. Smith
*Attorney, Agent, or Firm*—Charles R. Miranda

[57] ABSTRACT

Auxiliary trimmer unit for an electric dry shaver comprising a stationary and a movable cutter wherein the movable cutter is provided with spaced dual cutting surfaces. A guard unit is provided for the trimmer unit and means are provided to permit shifting of the guard alternately from a position where a first of the cutting surfaces of the trimmer is covered and a second position where the first cutting surface is exposed.

13 Claims, 7 Drawing Figures

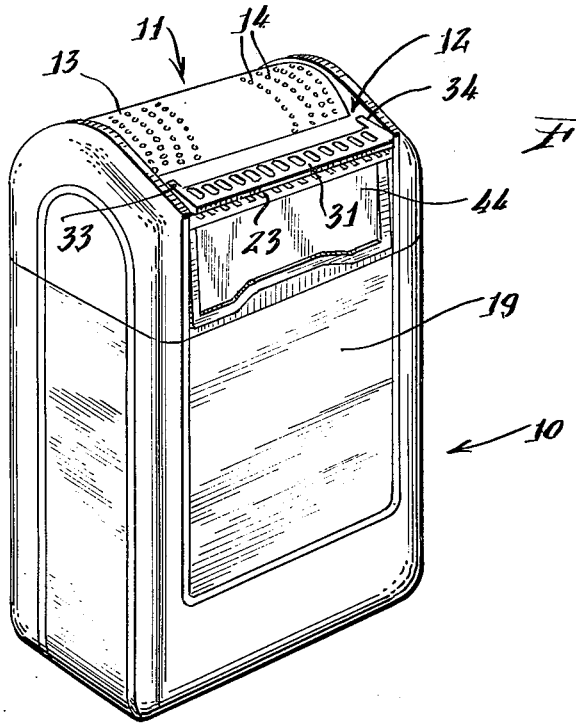
Fig. 1.
Fig. 2.
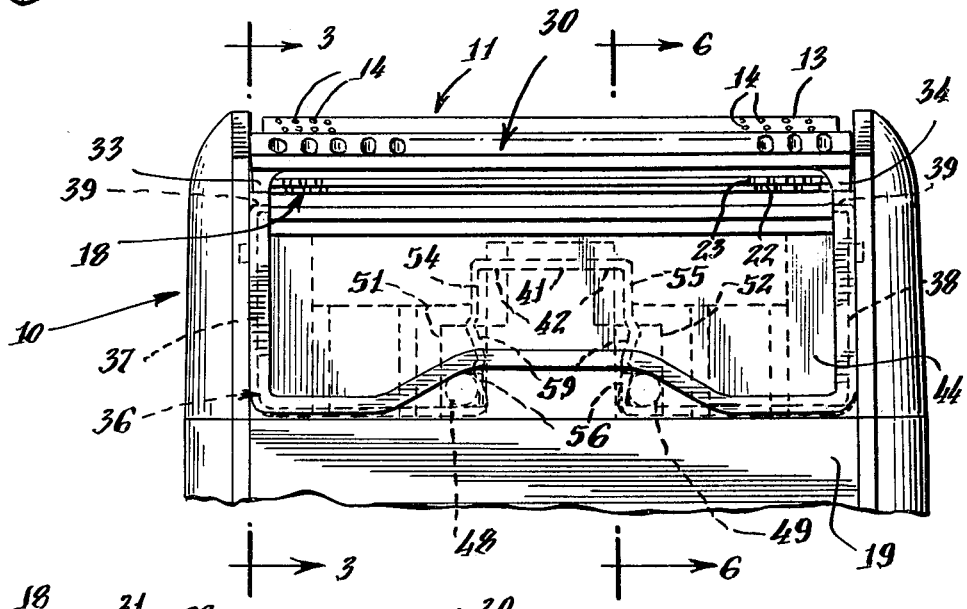
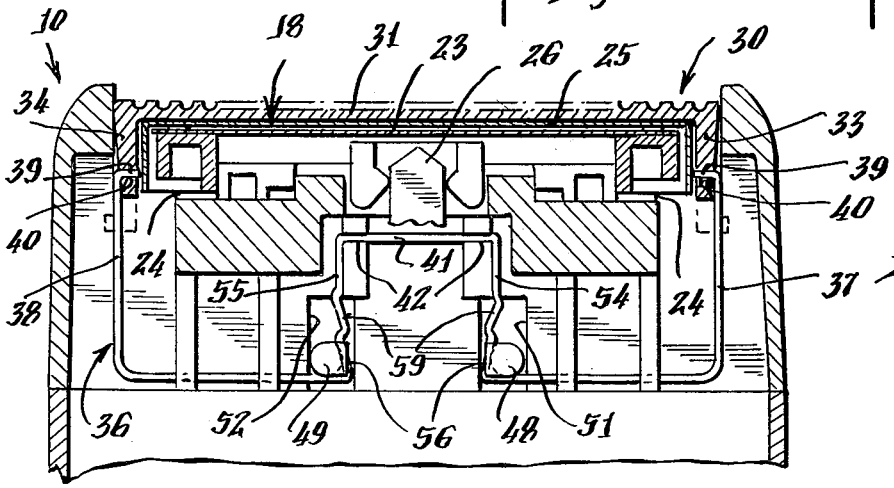
Fig. 5.

Fig. 3.
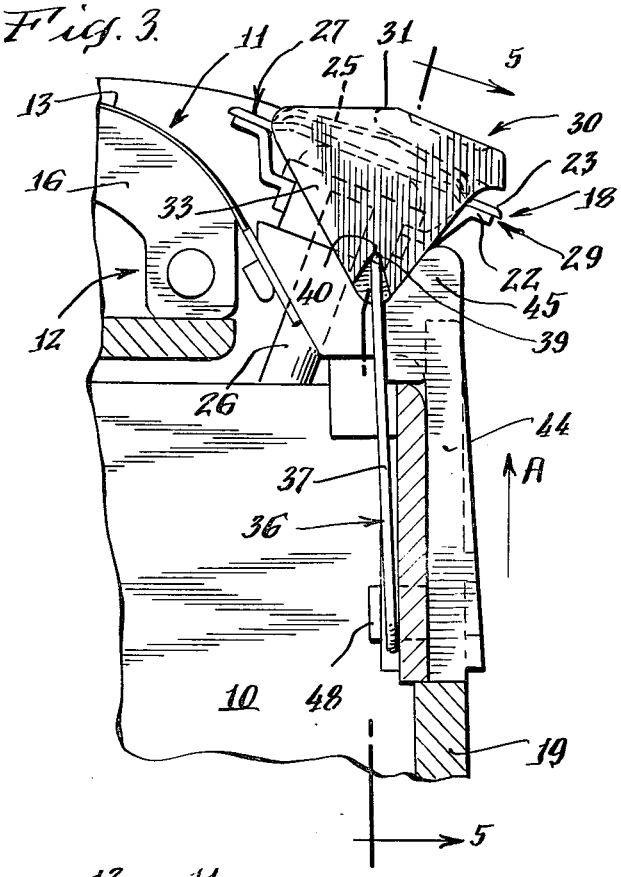
Fig. 4.
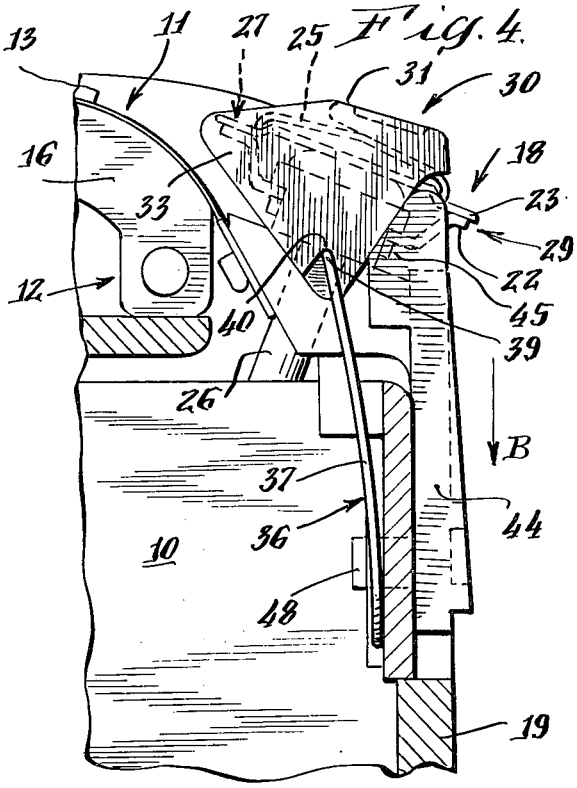
Fig. 6.
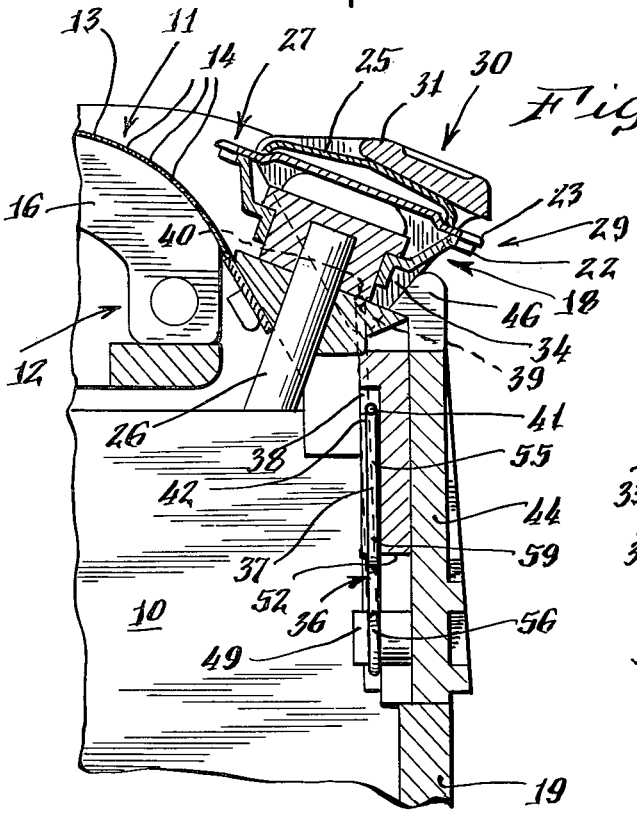
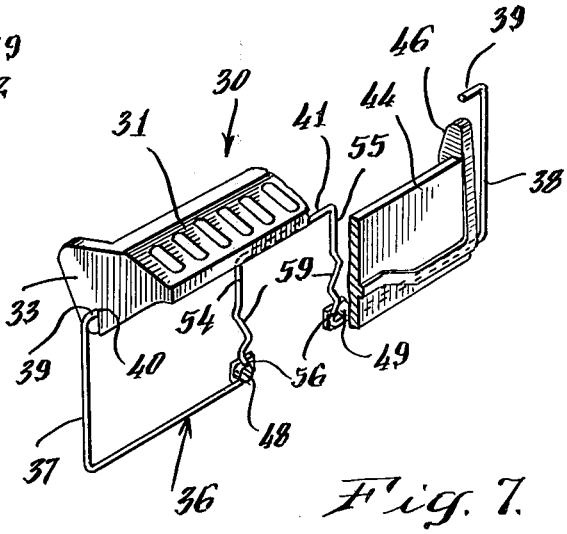
Fig. 7.

AUXILIARY TRIMMER ASSEMBLY

BACKGROUND OF THE INVENTION

This invention relates to new and useful improvements in electric dry shavers and more particularly to auxiliary hair trimmer units and protective guard means therefor.

Auxiliary trimmer units for electric dry shavers are well-known. The latter type units usually include a stationary outer cutter and a movable inner cutter. The trimmer unit is provided with a flat elongated leading cutting edge and is usually positioned adjacent the main cutter head and is utilized to trim the sideburns and moustache of the user. It is usual practice in use of these trimmer units to provide means for operating the movable cutter directly from the drive means for the main cutter head. In some shavers the trimmer unit is adapted for movement into and out of operative arrangement with the drive means. In other electric shavers the drive means operates the trimmer unit at the same time the main cutter head is operated. It is sometimes desirable in the latter units therefore to provide protective guard members for the trimmer device when the main cutter head is in operation or to protect the trimmer when the shaver is not being used.

Further in certain electric shavers utilizing trimmers additional means are often associated with the main cutter head to feed hair bristles thereto. In the latter type shaver the main cutter unit includes a thin metallic arcuate foil having a plurality of openings for feeding hair bristles to a movable inner cutter in the main cutter head. In view of the arcuate shape of the foil member problems are at times encountered in combing and feeding long hairs into the hair reception openings. Additional structure has been provided in these shavers such as comb devices or various slot arrangements to comb these long hairs into the cutter head assembly.

It is the object of the present invention to provide a novel cutter head and trimmer assembly for an electric dry shaver.

Another object is to provide a novel guard assembly for a hair trimmer unit.

Another object is to provide a novel trimmer unit and guard assembly therefor wherein the trimmer unit functions both as a trimmer device and as a hair bristle feeding and long hair shearing device for the main cutter head.

A still further object is to provide a compact hair trimmer unit and guard assembly comprised of a minimum number of parts which do not require increased area of operation within the shaver casing.

SUMMARY OF THE INVENTION

The present invention contemplates a novel trimmer unit and guard assembly for an electric dry shaver. In one embodiment the trimmer unit includes a movable cutter and a stationary cutter mounted adjacent the main cutter head. The trimmer unit is provided with dual cutting edges including a first cutting edge surface adjacent the main cutter head feeding hair bristles thereto and shearing long hairs not accepted by the main cutter head. A second cutting edge is spaced from the main cutter and projects outwardly of the shaver casing for trimming sideburns and moustaches. A guard assembly is provided for the trimmer device and includes means for mounting a guard member for movement between first and second positions for alternately covering and exposing the second cutting edge of the trimmer unit.

The above and other objects and advantages of the present invention will appear more fully hereinafter from a consideration of the detailed description which follows taken together with the accompanying drawing where one embodiment of the invention is illustrated.

DESCRIPTION OF THE DRAWINGS

In the drawings:

FIG. 1 is a perspective view of an electric dry shaver incorporating the present invention;

FIG. 2 is an enlarged fragmentary front elevational view of the upper portion of the electric dry shaver of FIG. 1;

FIG. 3 is a sectional view taken on the line 3—3 of FIG. 2 showing the guard assembly in first position;

FIG. 4 is a view similar to FIG. 3 and shows the guard in a second moved position;

FIG. 5 is a sectional view taken along the line 5—5 of FIG. 3;

FIG. 6 is a sectional view taken along the line 6—6 of FIG. 2; and

FIG. 7 is a perspective fragmentary view showing portions of the guard assembly and actuating means therefor.

DETAILED DESCRIPTION OF THE DRAWINGS

Referring now to the drawings for a more detailed description of the present invention, an electric dry shaver which incorporates one embodiment of the present invention is generally indicated by the reference numeral 10 (FIG. 1). Electric dry shaver 10 is of a generally usual type construction having a main cutter head assembly 11 located in a cutter head receptacle 12 in one end thereof powered by a suitable electric motor and drive means (not shown).

Main cutter head assembly 11 includes an arcuate shaped foil outer cutter 13 (FIGS. 1 and 3) having hair reception slots 14 for combing and feeding hair bristles to a movable inner cutter within main cutter head comprising a plurality of arcuate shaped blades one of which is shown in FIG. 3 and indicated by the reference numeral 16.

As mentioned it is a feature of the present invention to provide novel means for mounting a trimmer unit and guard assembly on shaver casing 10. To this end a hair trimmer unit indicated by the reference numeral 18 is mounted on the upper portions of casing front wall 19. Trimmer unit 18 comprises an elongated movable inner cutter 22 adapted for reciprocation relative to a stationary toothed guard or outer cutter member 23. The opposite ends of outer cutter 23 are secured to projections 24 on casing 10 and positioned thereon by means of a clamping member 25. A drive arm extension 26 extends from the main cutter drive means and is connected to inner cutter 22 in a usual manner for reciprocating the same relative to outer cutter 23 as the main cutter head 11 is operated.

Inner cutter 22 of trimmer assembly 18 is provided with spaced and parallel rows of cutting edges or surfaces 27 and 29 respectively. The cutting surface 27 is positioned in an imaginary plane 0° to 20° above the top surface of arcuate foil 13. Cutting surface 27 extends longitudinally of foil 13 and feeds hair bristles into hair reception slots 14 of main cutter head 11 while at the same time shearing long hairs which are not accepted by the slots 14. The second cutting surface 29 projects outwardly of cutter head receptacle 12 (FIGS. 3 and 4) and is utilized to trim sideburns and moustaches.

A guard assembly 30 is provided for trimmer unit 18 to alternately cover or uncover cutting surface 29 in accordance with the desired position of operation of trimmer 18. To this end an elongated guard member 31 is disposed over trimmer unit 18. Guard member 31 is formed of a premolded plastic material and is provided with triangular shaped end pieces 33 and 34 (FIG. 5) depending into casing 10 adjacent the opposite ends of a trimmer unit 18.

Means are provided for mounting guard 31 for movement from a position covering cutting surfaces 29 (FIG. 3) to a second position exposing cutting surface 29 (FIG. 4) in the trim position. The mounting means includes a generally W-shaped spring 36 disposed against the inner face of casing wall 19 (FIG. 5). The opposite spring end arms 37 and 38 of spring 36 are provided with bent hook end portions 39 disposed in apertures 40 provided in depending ends 33–34 of guard member 31 thereby securing spring 36 thereto. Spring 36 and guard 31 are maintained in casing 10 by means of the central bight portion 41 of spring 36 (FIG. 5) clamped about bosses 42 on the inner curface of casing wall 19.

A rectangular shaped actuator plate 44 for moving guard 31 between said first and second positions is slidably mounted on the outer face of casing wall 19 (FIGS. 1 and 2). Camming projections 45–46 (FIG. 5) are provided on the ends of plate 44 and engage the depending end portions 33–34 of guard 21. Spaced projections 48–49 are provided on the inner surface of plate 44 and extend through elongated vertical openings 50–51 respectively in wall 19 and engage lower detent portion 53 formed on legs 54–55 of the bight portion 41 of spring 36 in the lower position of slide 44 as shown in FIG. 3.

In accordance with the above described structure if it is desired to shift guard 31 from the position shown in FIG. 3 wherein guard 31 covers the outer edge cutting surface 29 of trimmer 18 to the second position (FIG. 4) where the cutting edge surface 29 is uncovered, the actuator plate 44 is manually moved upwardly in a direction of arrow A (FIG. 3). Cam surfaces 45–46 of slide 44 pivot against depending ears 33–34 of guard 31 moving guard 31 rearwardly to the position shown in FIG. 4. As plate 44 moves upwardly projections 48–49 are thereby freed from lower detent portions 53 of spring 36 and move into second upper detent portions 56. As guard 31 assumes the position shown in FIG. 4 spring arms 37–38 are flexed to a loaded position and maintained therein by the detenting action of detents 56 against projection 48–49 of plate 44.

If it is desired to return guard 31 to the first position (FIG. 3) plate 44 is manually moved in the direction of arrow B (FIG. 4) freeing projections 48–49 from detent 56 and thus permitting spring arms 37–38 to unload and release guard 31 to the first position.

It will be noted that in either moved position of guard member 31 cutting surface 27 is exposed for use since the adjacent surface of guard member 31 is receded from the cutting edge 27. It is within the scope of this invention that guard member 31 can be configurated to fully cover cutting edge 27 when cutting edge 29 is exposed.

It will be apparent from the foregoing description that the novel trimmer unit 18 and guard assembly 30 have many advantages in use, one advantage among others is that separate and effective means is provided for protecting a trimmer unit in a plurality of operative positions. In addition the novel position and construction of the trimmer unit allows for dual operating functions thereof in an efficient manner.

Although one embodiment of the present invention has been illustrated and described in detail, it is to be expressly understood that the invention is not limited thereto. Various changes can be made in the design and arrangement of parts without departing from the spirit and scope of the invention as the same will now be understood by those skilled in the art.

What is claimed is:

1. In an electric dry shaver, a. a casing having a main cutter head mounted thereon, b. a trimmer unit mounted on said casing adjacent said main cutter head and having a cutting surface formed by a stationary cutter and movable cutter mounted for movement relative thereto, c. a protective guard assembly for said trimmer unit including a member for covering the cutting surface thereof, d. said movable cutter of said trimmer unit provided with a pair of spaced and parallel rows of cutting surfaces, the first surface arranged in a plane above the main cutter head and the second surface projecting outwardly of said casing, and e. means mounting said guard member for controlled movement between positions alternately covering or exposing said second cutting surface and including spring means attached to said casing and having portions connected to said guard member.

2. The device of claim 1 wherein actuating means are provided for effecting and controlling movements of said guard member and include a control member slidably mounted on the outer surface of said casing having portions in camming engagement with said guard member.

3. The device of claim 2 wherein said control member comprises a slide member provided with portions extending into said casing and wherein said spring member includes detent means associated with said slide portions for detenting said slide in a plurality of moved positions.

4. In an electric dry shaver, a. a casing having a main cutter assembly, mounted thereon, b. a trimmer having a cutter assembly provided with a first cutting surface adjacent the main cutter head and a second cutting surface projecting outwardly of said casing, c. a guard assembly for said trimmer including a guard member on said casing to cover at least one of said cutting surfaces, d. means mounting said guard member for movement between first and second positions to alternately cover and expose said at least one cutting surface, e. said mounting means including a spring means secured to said casing and having portions connected to said guard member and f. an actuator slide on the surface of said casing having portions in camming engagement with said guard member for effecting movement of said guard member between said first and second positions.

5. The device of claim 4 wherein said spring means including a spring member having spaced resilient arms secured to said guard member and adapted to assist in movement of said guard member between said first and second positions and wherein said spring member further includes portions for detenting said slide member in each of said positions.

6. The device of claim 5 wherein said spring member comprise a spring of a W-shaped configuration the opposite arms of said spring connected to said guard member and the central bight portion of said spring connected to said shaver casing.

7. The device of claim 6 wherein said detents means are provided adjacent said bight portion for detenting said slide member in said first and second positions of movement.

8. The device of claim 4 wherein said slide member is provided with a pair of projections on one surface thereof, slot means provided in said casing for receiving said projections and detent means formed on said spring member for detenting said projections in moved positions of said slide means.

9. The device of claim 8 wherein said spring means include a spring member provided with leaf spring arms connected to said guard member for mounting said guard member and assisting in the movement of said guard member between said first and second positions.

10. In an electric dry shaver, a. a casing having a main cutter head, b. a trimmer unit having an elongated stationary cutter and a movable cutter movably mounted in shearing relation thereto, c. means for mounting said trimmer unit adjacent said main cutter head, d. a guard assembly for said trimmer unit and including an elongated member mounted for pivotal movement on said casing over said trimmer unit between spaced positions alternately covering and exposing the cutting surface to prevent hair entry thereto, and e. actuating means on the casing interconnected to said guard assembly operable for selectively moving the guard member between said spaced positions.

11. The shaver of claim 10 wherein said movable cutter of said trimmer unit is provided with a pair of spaced and parallel rows of cutting surfaces, a first cutting surface of said pair of surfaces is arranged adjacent the main cutter head and a second cutting surface of said pair of surfaces projecting outwardly of the casing and wherein said guard member is adapted to alternately cover or expose said second cutting surface.

12. The shaver of claim 11 wherein said actuating means for moving said guard member include a control member slidably mounted on the outer surface of the casing having portions in camming engagement with said guard member.

13. The shaver of claim 12 wherein said control member comprises a slide member provided with portions extending into said casing and wherein spring means are provided having a portion secured to the casing and to the guard member and detent means associated with the slide member portions for detenting the slide member in a plurality of moved positions.

* * * * *